US010308485B2

(12) United States Patent
Kuo et al.

(10) Patent No.: US 10,308,485 B2
(45) Date of Patent: Jun. 4, 2019

(54) OFFSHORE PLATFORM LIFTING DEVICE

(71) Applicant: SEA ENERGY TECHNOLOGY CO., LTD., Taichung (TW)

(72) Inventors: Chung Hsuan Kuo, Taichung (TW); Fang Sheng Kuo, Taichung (TW)

(73) Assignee: Sea Energy Technology Co., Ltd., Taichung (TW)

( * ) Notice: Subject to any disclaimer, the term of this patent is extended or adjusted under 35 U.S.C. 154(b) by 0 days.

(21) Appl. No.: 16/238,261

(22) Filed: Jan. 2, 2019

(65) Prior Publication Data

US 2019/0135590 A1 May 9, 2019

Related U.S. Application Data

(63) Continuation-in-part of application No. 16/047,257, filed on Jul. 27, 2018.

(30) Foreign Application Priority Data

Aug. 14, 2017 (TW) ..... 106127478 A

(51) Int. Cl.
*B66C 23/52* (2006.01)
*B66C 23/18* (2006.01)
(Continued)

(52) U.S. Cl.
CPC ..... *B66C 23/18* (2013.01); *B63B 35/44* (2013.01); *B63B 43/04* (2013.01); *B66C 23/54* (2013.01); *B66C 23/82* (2013.01); *B66C 23/84* (2013.01); *E02B 17/0017* (2013.01); *E02B 17/02* (2013.01); *E02B 17/0872* (2013.01); *B63B 27/08* (2013.01); *B63B 2035/442* (2013.01); *B66C 23/52* (2013.01); *B66C 2700/0392* (2013.01); *E02B 2017/0056* (2013.01)

(58) Field of Classification Search
CPC ..... B66C 23/52; B63B 27/08; B63B 27/10
USPC ..... 294/67.33; 414/140.3, 140.4, 141.3, 414/141.4, 141.5, 141.6, 141.7, 142.6, 414/142.7, 142.8; 212/309–311
See application file for complete search history.

(56) References Cited

U.S. PATENT DOCUMENTS 3,303,939 A * 2/1967 Trevisan ..... B66C 23/605 212/311
3,486,635 A * 12/1969 Thomson ..... B66C 23/605 212/310

(Continued)

*Primary Examiner* — Sunil Singh
(74) *Attorney, Agent, or Firm* — C. G. Mersereau DeWitt LLP

(57) ABSTRACT

An offshore platform lifting device for lifting operations at sea after sailed to a certain position of a sea surface includes an upper deck, a plurality of upright columns, a rail seat, a base disposed on the rail seat, two davit arms, two first winches, and two second winches. The upper deck has a lower pontoon. The upright columns are connected between to the upper deck and the lower pontoon. Each upright column is provided with a support leg that is longitudinally inserted through the upright column, thereby positioning the offshore platform lifting device on the seabed through the upright columns. The two davit arms are disposed the base and drives the base to move laterally through a pushing device. The two second winches each have a second cable passing through the two davit arms. A hook is disposed at a distal end of the second cable.

11 Claims, 10 Drawing Sheets

(51) Int. Cl.

| | |
|---|---|
| ***E02B 17/00*** | (2006.01) |
| ***E02B 17/02*** | (2006.01) |
| ***E02B 17/08*** | (2006.01) |
| ***B66C 23/00*** | (2006.01) |
| ***B66C 23/84*** | (2006.01) |
| ***B63B 43/04*** | (2006.01) |
| ***B63B 35/44*** | (2006.01) |
| ***B66C 23/82*** | (2006.01) |
| *B63B 27/08* | (2006.01) |

(56) References Cited

U.S. PATENT DOCUMENTS

| | | | | | |
|---|---|---|---|---|---|
| RE29,478 | E | | 11/1977 | Goren et al. | |
| 4,078,665 | A | * | 3/1978 | Kuhl | B66C 23/52 212/299 |
| 4,191,502 | A | * | 3/1980 | Komatsu | B63B 27/04 212/310 |
| 4,341,315 | A | * | 7/1982 | Tseng | B63B 27/04 212/227 |
| 4,354,608 | A | * | 10/1982 | Wudtke | B66C 13/02 212/256 |
| 7,219,615 | B2 | | 5/2007 | Merchant et al. | |

* cited by examiner

OFFSHORE PLATFORM LIFTING DEVICE

This Application is being filed as a Continuation-in-Part of U.S. patent application Ser. No. 16/047,257, filed Jul. 27, 2018, currently pending, which was based on Taiwan Application No. 106127478, filed Aug. 14, 2017.

FIELD OF THE INVENTION

Background of the Invention

For lifting operation at sea, there is a platform that can be used on the sea. After the platform is sailed to a certain position, it can be used for lifting operation at sea. In order to maintain stability during the lifting operation, especially to avoid vertical fluctuations caused by wind and waves on the platform, a positioning means is used for positioning the platform on the sea surface, which is conducive to the stability and safety of the lifting operation.

US Patent Publication No. RE29478 and U.S. Pat. No. 7,219,615 B2 disclose another platform for operations at sea. This platform belongs to a semi-submersible platform and has a lower pontoon below an upper deck. The lower pontoon can be filled with water to sink, and the center of gravity can be moved down toward the sea surface. The platform can be tightened by cables or steel cables to avoid vertical floating caused by wind and waves on the platform to maintain the stability of the platform. However, it has been found in practice that even if the center of gravity of the platform is moved down toward the sea surface and the platform is tightened by the cables or steel cable, the platform is still be vertically fluctuation due to wind and waves, which will inevitably lead to instability during operations at sea.

In addition, the existing platform for offshore lifting operations adopts a rotatable davit arm that can rotate 360 degrees. The davit arm is composed of a hook, a support column and a rotating mechanism. The hook hoists the heavy object in cooperation with the rotating mechanism to allow the heavy object to be lifted at sea. However, this type of davit arm only relies on a single support column to bear the load. For the support column to lift the load, it is necessary to increase its volume to strengthen the structure. For the rotating mechanism to bear a large load and to cooperate with the volume of the support column, it is necessary to have a large volume to support the support column. For the rotating mechanism to push the support column to rotate, the rotating mechanism has a complicated structure and needs a plurality of driving units to rotate the support column, so the overall cost of the davit arm is high and the cost of the offshore lifting operation is also increased.

SUMMARY OF THE INVENTION

The primary object of the present invention is to provide an offshore platform lifting device, which uses support legs filled with seawater to sink to the seabed and a lower pontoon filled with seawater to move down toward the sea surface, thereby positioning the offshore platform lifting device in an economical and stable manner.

Another object of the present invention is to provide an offshore platform lifting device, which provides third winches to wind/unwind third cables for two davit arms to move laterally along a curved rail, in cooperation with second winches to wind/unwind second cables for lifting and lowering a heavy object hanged by hooks of the davit arms. The offshore platform lifting device not only allows the davit arms to load and lift the heavy object but also reduces the total production cost effectively and the cost of offshore lifting through the simple design of the overall structure.

In order to achieve the above object, the present invention provides an offshore platform lifting device for lifting operations at sea after sailed to a certain position of a sea surface. The offshore platform lifting device comprises an upper deck, a plurality of upright columns, a rail seat, a base, two davit arms, two first winches, and two second winches. The upright columns are connected to the upper deck and supported on a seabed. The rail seat is disposed on the upper deck. The rail seat has a curved rail. Two ends of the curved rail are provided with retaining walls. The upper deck has a center position relative to the curved rail. The center position is provided with a fixed pulley mechanism. The base is disposed on the curved rail. The base has a pushing device disposed on the upper deck for driving the base to slide along the curved rail. The two davit arms each have a first end and a second end. The second ends of the two davit arms are pivotally connected to the base and arranged side by side. The first end is provided with a first pulley and a second pulley. The two first winches are disposed on the upper deck. The two first winches each have a first cable passing through the first pulley of a corresponding one of the two davit arms and connected to the fixed pulley mechanism. When the two first winches each wind and unwind the first cable, the two davit arms are pivoted up and down with the second end as an axis. Two second winches are disposed on the upper deck. The two second winches each have a second cable passing through the second pulley of a corresponding one of the two davit arms. A hook is disposed at a distal end of the second cable.

Preferably, the upper deck is connected to a lower pontoon through the upright columns. Each upright column is provided with a support leg that is longitudinally inserted through the upright column. The lower pontoon has a plurality of chambers therein. The chambers are configured to receive water therein so that the lower pontoon sinks downwardly when the water is introduced into the chambers or floats upwardly when the water is drained out. The support leg has a compartment. The compartment is configured to receive water therein so that the support leg sinks downwardly when the water is introduced into the compartment or floats upwardly when the water is drained out. Each upright column includes a leveling mechanism therein. When the support leg sinks to reach the seabed, the leveling mechanism in each upright column is combined with the support leg to support the support leg. The leveling mechanism drives the upper deck to move up or down along the support leg.

Preferably, each upright column is provided with a wave-dissipating channel. The wave-dissipating channel has through holes on a plurality of sides of the upright column. The through holes communicate with each other through a pipe in the upright column. When a wave meets the upright column, seawater flows in through one of through holes and flows out through the other through holes via the pipe to eliminate the force of the wave against the upright column.

Preferably, the leveling mechanism located in each upright column has a plurality of upper positioning cylinders disposed in an upper seat and a plurality of lower positioning cylinders disposed in a lower seat. The upper seat and the lower seat are connected by a plurality of jacking cylinders. Each of the upper positioning cylinders and the lower positioning cylinders has a positioning rod that is extendable and retractable horizontally. The support leg supported by the leveling mechanism has positioning holes for receiving the positioning rods of the upper positioning cylinders and the lower positioning cylinders. The positioning rods of the plurality of upper positioning cylinders or the positioning rods of the plurality of lower positioning cylinders are respectively extended into the positioning holes of the support leg. The lower seat is driven to be close to or away from the upper seat by the plurality of jacking cylinders for driving the upper deck to move up or down.

Preferably, the fixed pulley mechanism includes a positioning seat and a fixed pulley assembly pivotally connected to the positioning seat. The positioning seat has a rail below the fixed pulley assembly. A bottom of the fixed pulley assembly has a plurality of second rollers. The fixed pulley assembly slides along the rail via the second rollers.

Preferably, a hydraulic device is disposed on the positioning seat. The hydraulic device is configured to drive the fixed pulley assembly, so that the fixed pulley assembly is pivoted laterally along the rail with its pivotal joint as an axis.

Preferably, at least one bracket is disposed between the two davit arms.

Preferably, the base has a pivot portion exposed out of the curved rail. The second ends of the two davit arms are pivotally connected to the pivot portion and arranged side by side.

Preferably, the curved rail has a rectangular cross section. The curved rail has a top surface, a bottom surface, a front surface away from the center position, and a rear surface opposite to the front surface. An opening is defined at the junction of the front surface and the top surface. The pivot portion of the base is exposed out of the curved rail through the opening. Each of the bottom surface and the rear surface is provided with a plurality of first rollers.

Preferably, the bottom surface is inclined toward the rear surface. Each of the first rollers on the bottom surface has a conical shape that is gradually enlarged toward the rear surface.

Preferably, the pushing device is composed of two third winches disposed on the upper deck. The base is composed of two sliders respectively disposed on the two davit arms. Each of the two sliders is provided with a third pulley. Each of the two retaining walls is provided with a diverting pulley. The two third winches each have a third cable passing through the diverting pulley and connected to the third pulley. When the two third winches each wind and unwind the third cable, the two sliders slide along the curved rail.

DETAILED DESCRIPTION OF THE PREFERRED EMBODIMENTS

Figure 1:
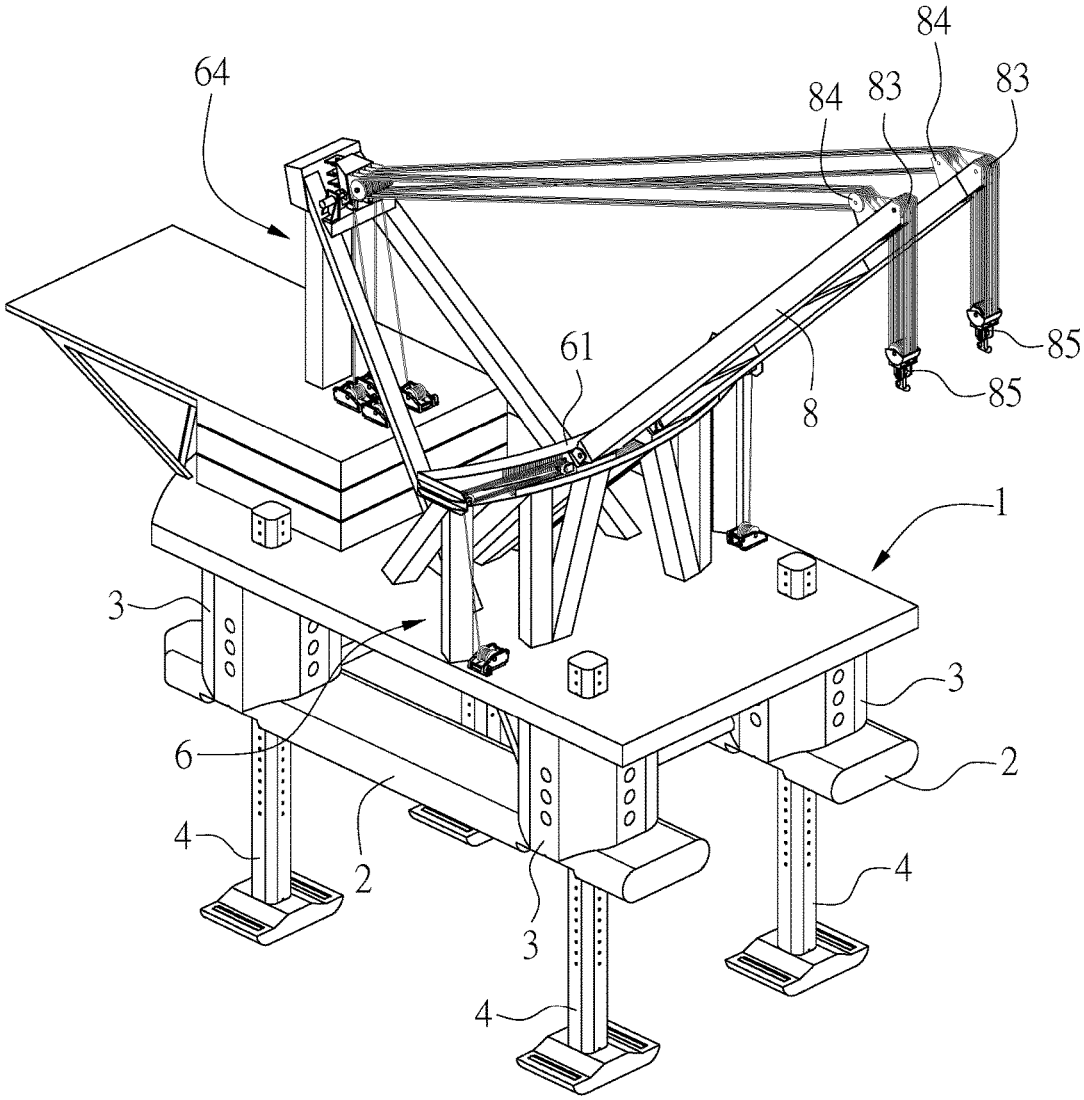
FIG. 1 is a perspective view of the present invention.

The present invention provides an offshore platform lifting device for lifting operations at sea after sailed to a certain position of a sea surface A. As shown in FIG. 1, the offshore platform lifting device mainly comprises an upper deck 1, a plurality of upright columns 3, a rail seat 6, a base 7, two davit arms 8, two first winches 91, and two second winches 92.

Figure 2:
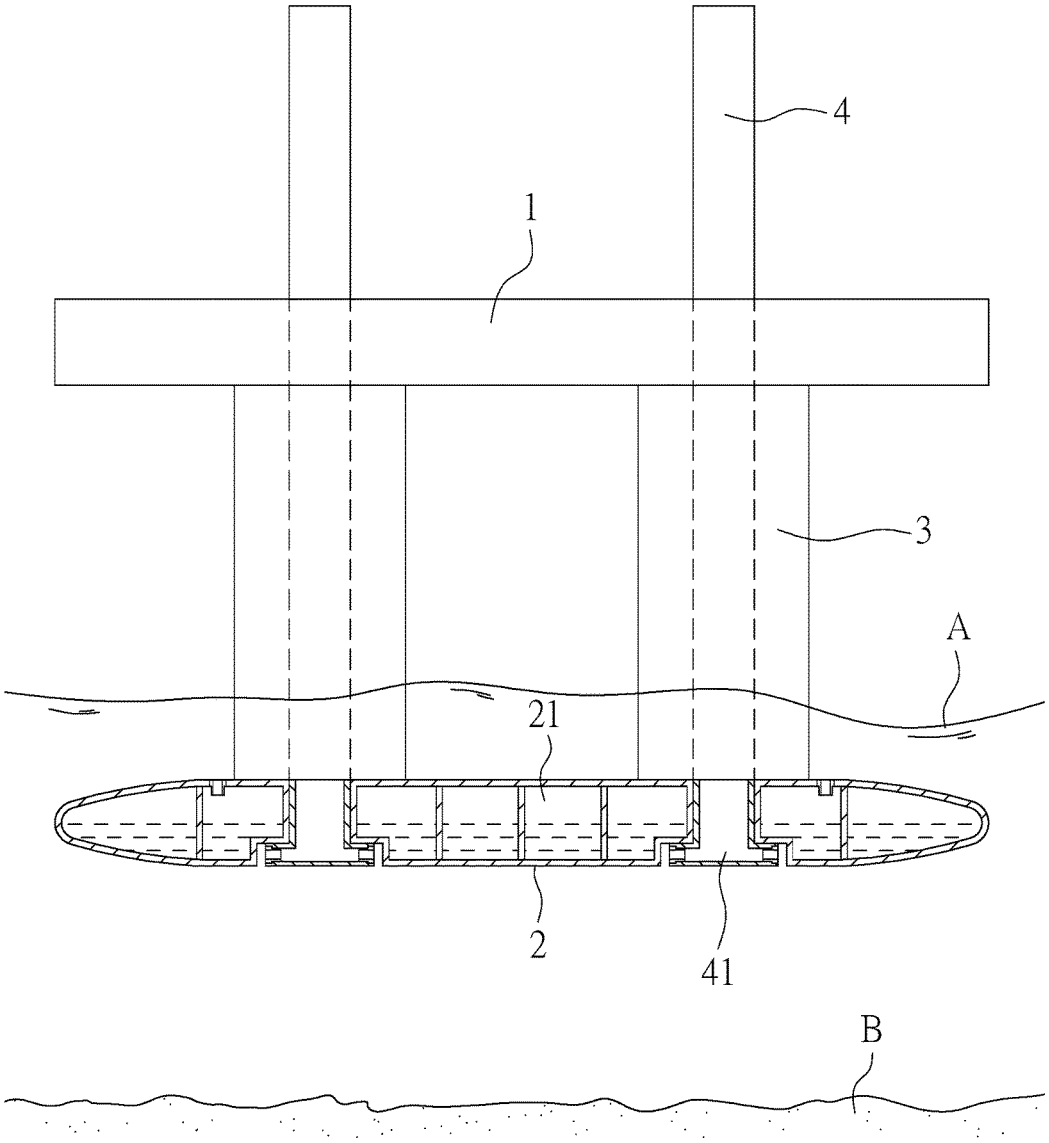
FIG. 2 is a partial planar view of the present invention, showing the upper deck, the lower pontoon and the upright columns.

As shown in FIG. 2, the upper deck 1 is connected to a lower pontoon 2 by the respective upright columns 3. Each upright column 3 is provided with a support leg 4 that is longitudinally inserted through the upright column 3. The lower pontoon 2 has a plurality of chambers 21 therein. The chambers 21 are configured to receive water therein so that the lower pontoon 2 can sink downwardly when the water is introduced into the chambers 21 or float upwardly when the water is drained out. The operator can adjust the overall center of gravity of the offshore platform lifting device by controlling water filling into or draining out of the chambers 21. The support leg 4 has a compartment 41. The compartment 41 is configured to receive water therein so that the support leg 4 can sink downwardly when the water is introduced into the compartment 41 or float upwardly when the water is drained out. The compartment 41, in this embodiment, is located at the bottom of the support leg 4.

Figure 3:
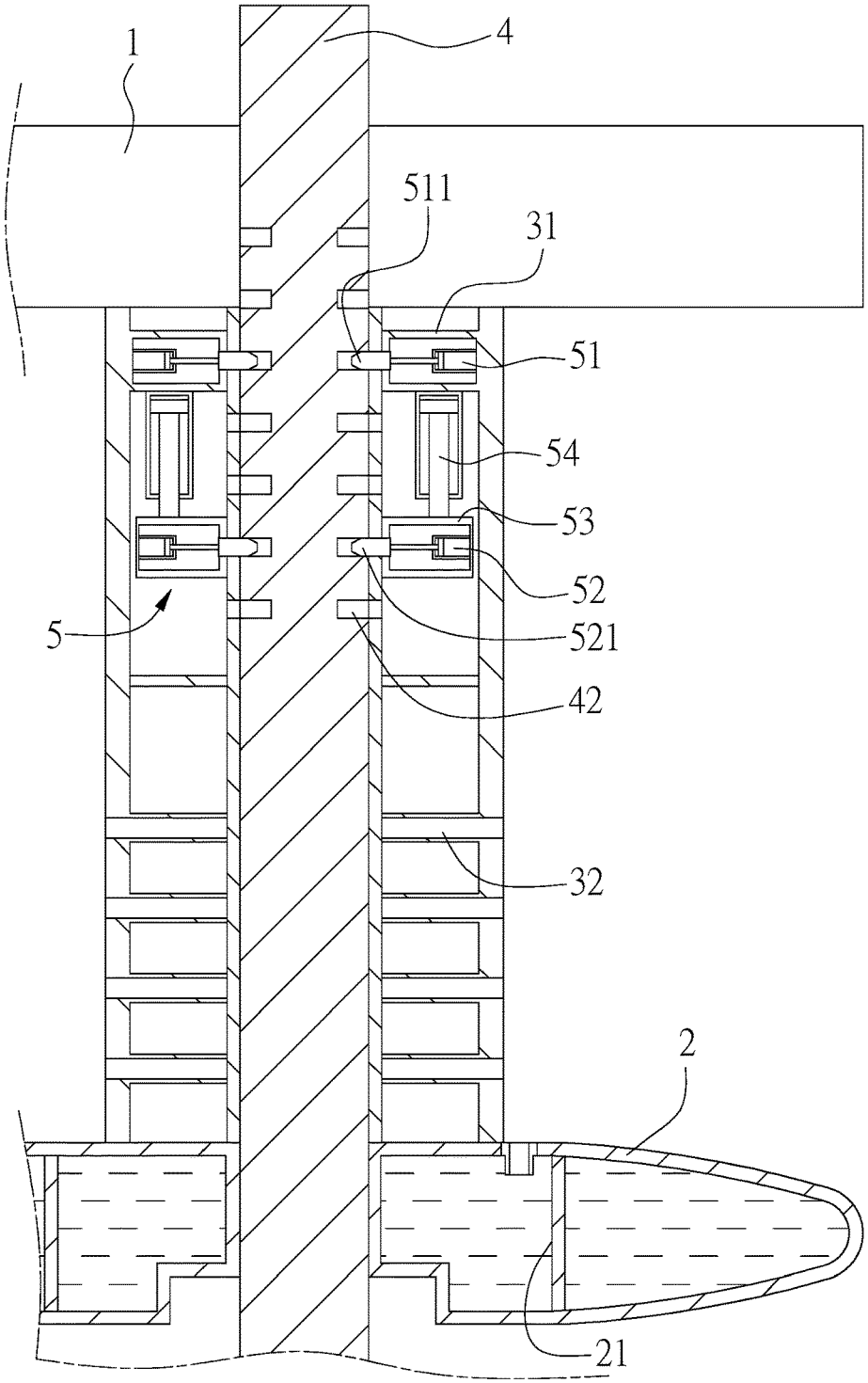
FIG. 3 is a schematic view of the upright column having the leveling mechanism and the wave-dissipating channel of the present invention.

As shown in FIG. 3, each upright column 3 includes a leveling mechanism 5 therein. When the support leg 4 sinks to reach the seabed B, the leveling mechanism 5 in each upright column 3 is combined with the support leg 4 to support the support leg 4. The leveling mechanism 5 can drive the upper deck 1 to move up or down along the support leg 4. In this embodiment, the leveling mechanism 5 in each upright column 3 has a plurality of upper positioning cylinders 51. The upper positioning cylinders 51 are disposed in an upper seat 31. The leveling mechanism 5 further has a plurality of lower positioning cylinders 52. The lower positioning cylinders 52 are disposed in a lower seat 53. The upper seat 31 and the lower seat 53 are connected by a plurality of jacking cylinders 54. Each of the upper positioning cylinders 51 has a positioning rod 511 that can be extended and retracted horizontally. Each of the lower positioning cylinders 52 has a positioning rod 521 that can be extended and retracted horizontally. The support leg 4 supported by the leveling mechanism 5 has positioning holes 42. The positioning holes 42 are configured to receive the positioning rods 511, 521. Thereby, the positioning rods 511 of the plurality of upper positioning cylinders 51 or the positioning rods 521 the plurality of lower positioning cylinders 52 can be respectively extended into the positioning holes 42 of the support leg 4. The lower seat 53 can be driven close to or away from the upper seat 31 by the plurality of jacking cylinders 54 to drive the upper deck 1 to move up or down.

Figure 4:
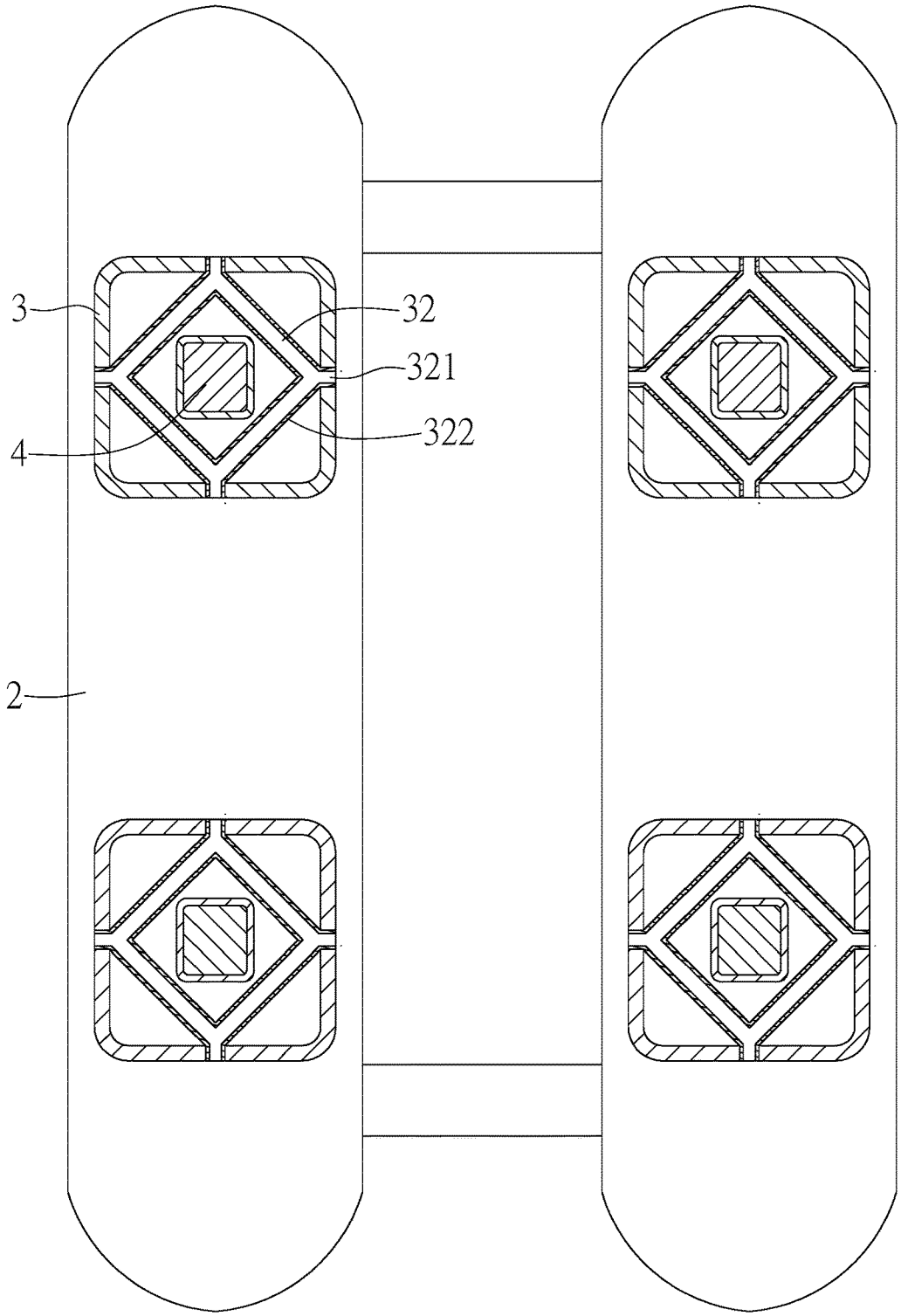
FIG. 4 is a cross-sectional view of the wave-dissipating channels in the square upright columns of the two lower pontoons of the present invention.
Figure 5:
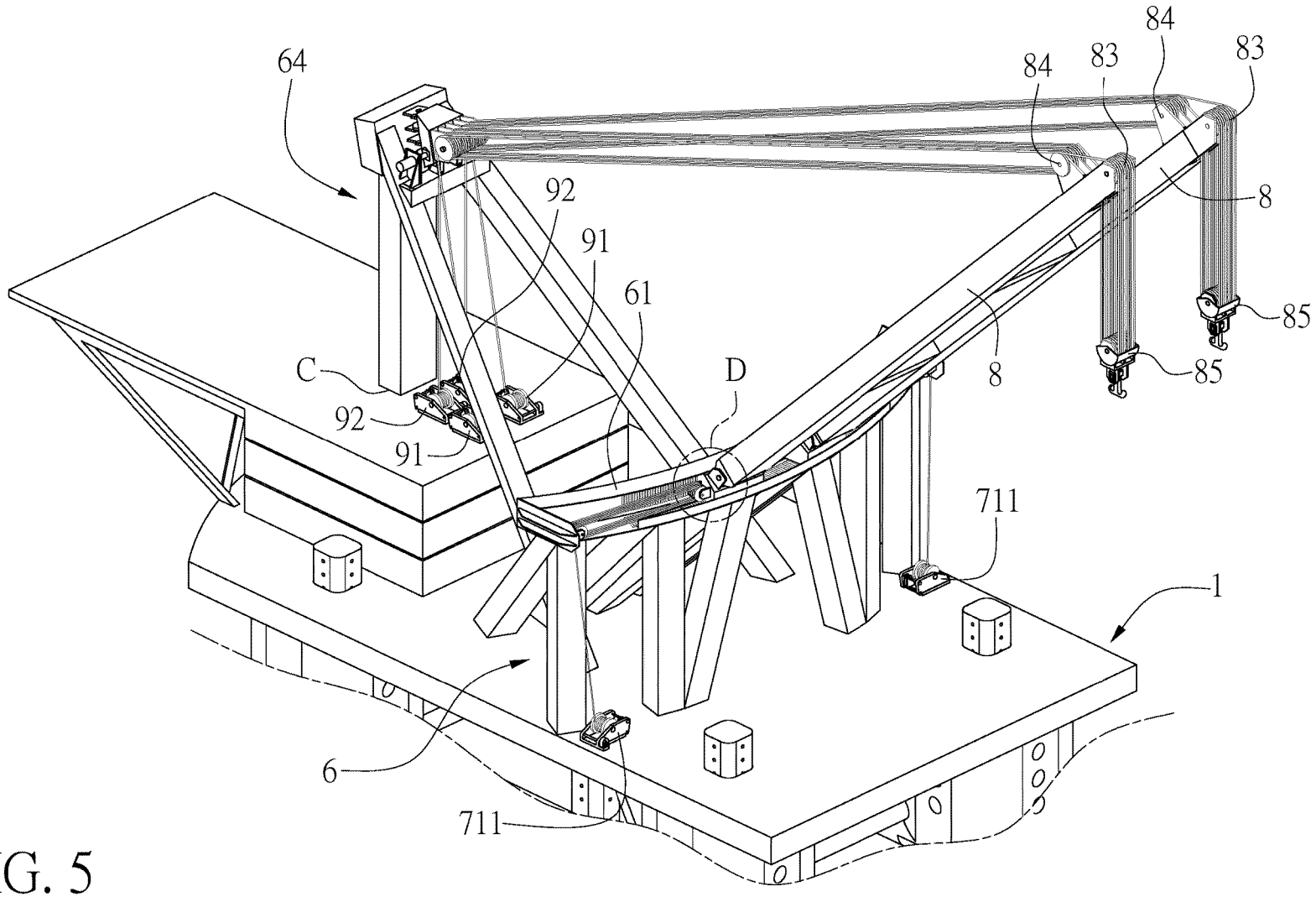
FIG. 5 is a partial structural view of the present invention, showing the three-dimensional structure above the upper deck.
Figure 6:
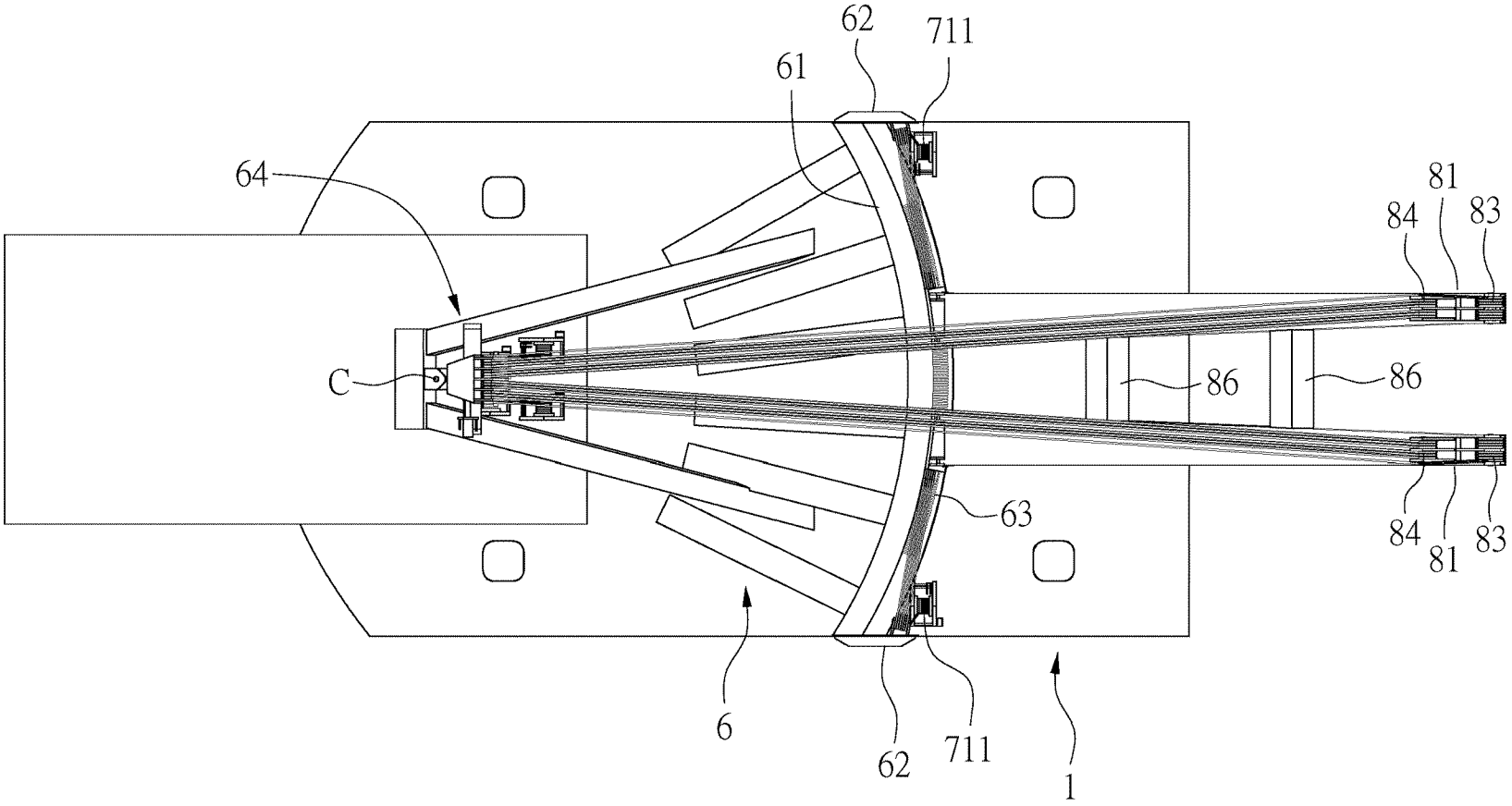
FIG. 6 is a top schematic view of the present invention.

As shown in FIG. 4, each upright column 3 is provided with a wave-dissipating channel 32 having through holes 321 on a plurality of sides of the upright column 3. The plurality of through holes 321 communicate with each other through a pipe 322 in the upright column 3. When the wave meet the upright column 3, the seawater flows in through one of through holes 321 and flows out through the other through holes 321 via the pipe 322 to eliminate the force of the wave against the upright column 3. As shown in FIG. 4, this embodiment has two lower pontoons 2. Each lower pontoon 2 has two upright columns 3 arranged in tandem.

As shown in FIGS. 5 to 9, the rail seat 6 is disposed on the upper deck 1. The rail seat 6 has a curved rail 61. Two ends of the curved rail 61 are provided with retaining walls 62. The upper deck 1 has a center position C relative to the curved rail 61. The center position C is provided with a fixed pulley mechanism 64. As shown in FIG. 3, in the embodiment, the fixed pulley mechanism 64 includes a positioning seat 641 and a fixed pulley assembly 642 pivotally connected to the positioning seat 641. The positioning seat 641 has a rail 643 below the fixed pulley assembly 642. The bottom of the fixed pulley assembly 642 has a plurality of second rollers 644, so that the fixed pulley assembly 642 can slide along the rail 643 via the second rollers 644.

A hydraulic device 645 is disposed on the positioning seat 641. The hydraulic device 645 is configured to push the fixed pulley assembly 642, so that the fixed pulley assembly 642 is pivoted laterally along the rail 643 with its pivotal joint as an axis, thereby allowing the fixed pulley assembly 642 to move more smoothly.

Figure 7:
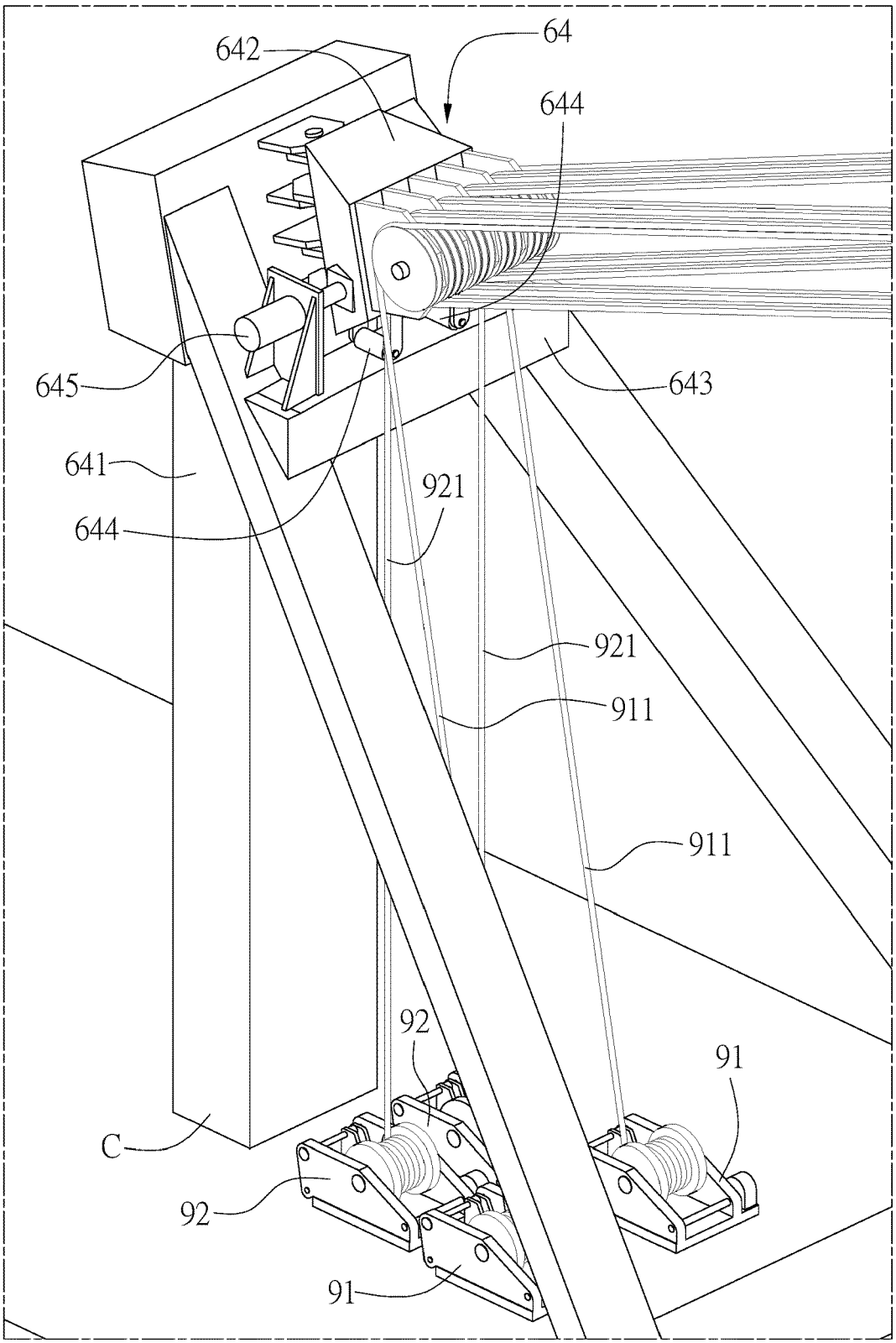
FIG. 7 is a structural view of the fixed pulley mechanism of the present invention.
Figure 8:
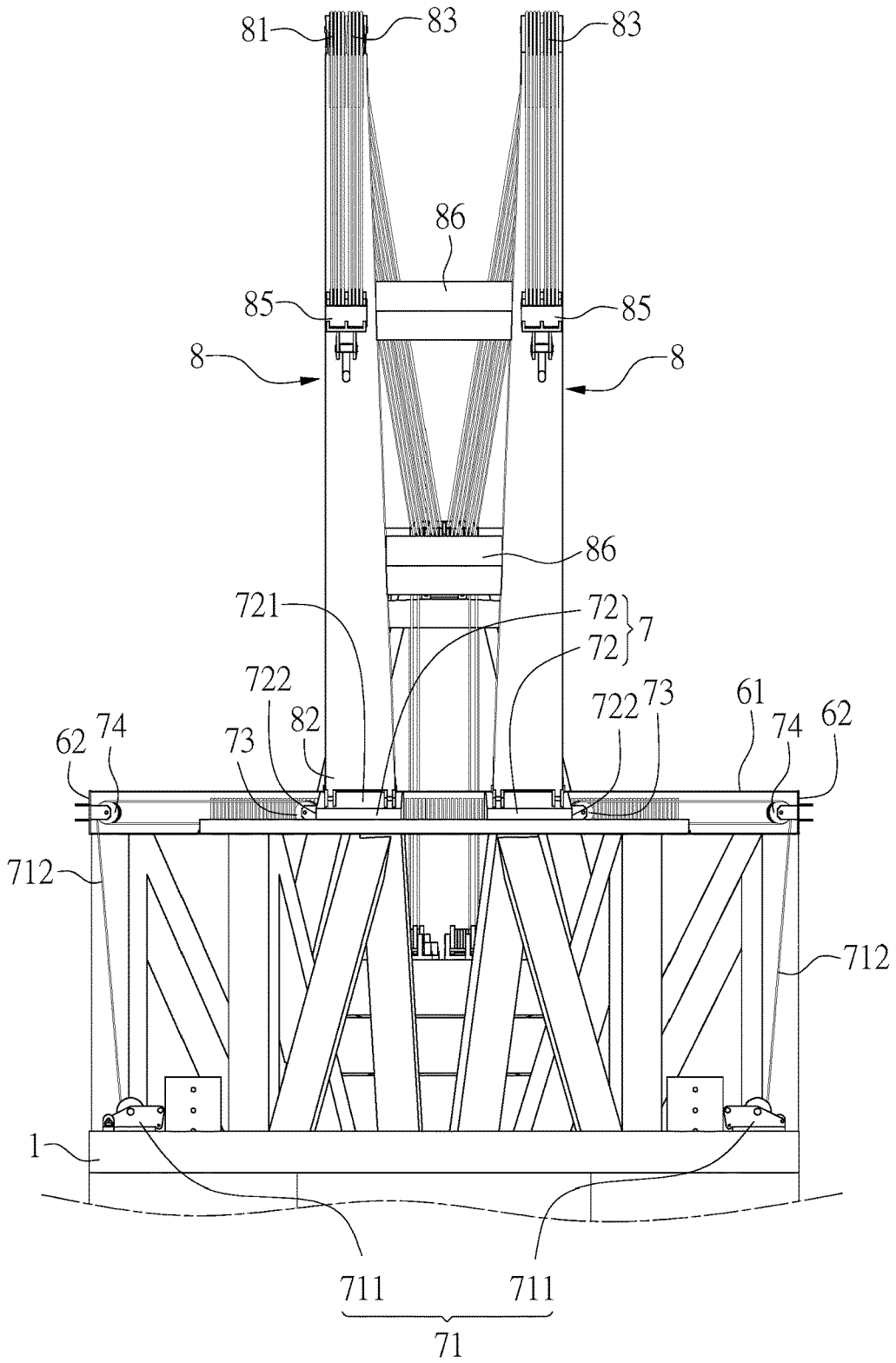
FIG. 8 is a front view of FIG. 5.
Figure 9:
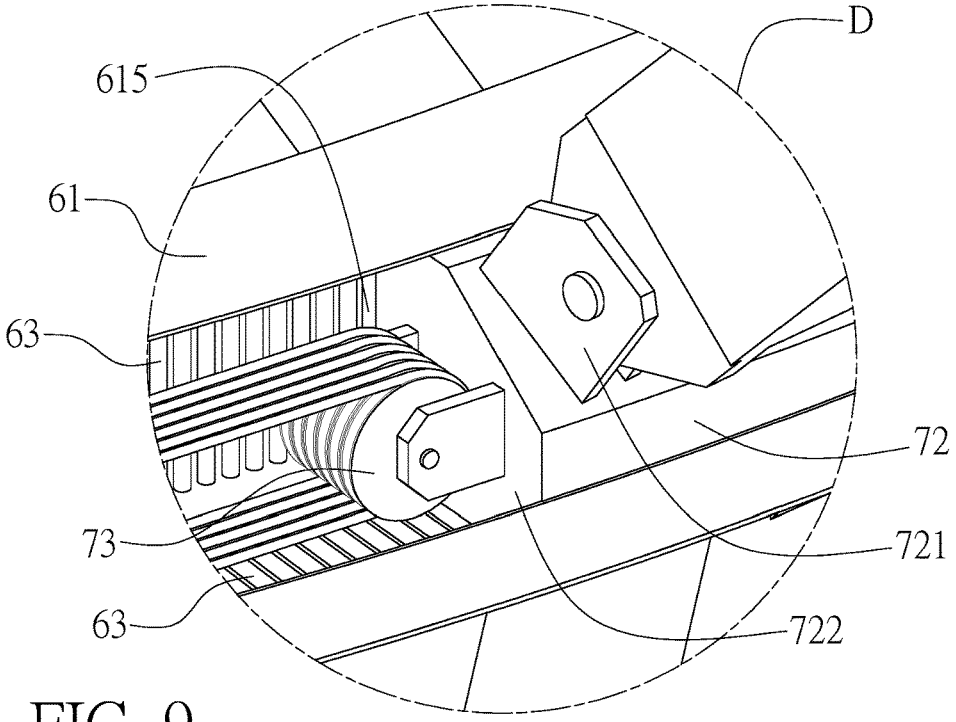
FIG. 9 is an enlarged view of circle D of FIG. 5.

As shown in FIG. 7 and FIG. 8, the base 7 is disposed on the curved rail 61. The base 7 has a pushing device 71 disposed on the upper deck 1 for driving the base 7 to slide along the curved rail 61. In this embodiment, the base 7 is composed of two sliders 72 that are spaced apart from each other. The two sliders 72 each have a pivot portion 721 exposed out of the curved rail 61.

The pushing device 71 is composed of two third winches 711. The two third winches 711 are disposed on the upper deck 1 and correspond in position to the two retaining walls 62 of the curved rail 61. The two sliders 72 define two outer sides 722 that are disposed away from each other. A third pulley 73 is disposed on each of the outer sides 722. Each of the two retaining walls 62 is provided with a diverting pulley 74. The two third winches 711 each have a third cable 712 passing through the diverting pulley 74 and connected to the third pulley 73. The two third winches 711 each can wind and unwind the third cable 712 to slide the two sliders 72 along the curved rail 61, thereby adjusting the lateral position of the two sliders 72.

The two davit arms 8 each have a first end 81 and a second end 82. The second ends 82 of the two davit arms 8 are pivotally connected to the pivot portions 721 of the two sliders 72 and are arranged side by side. The first end 81 is provided with a first pulley 84 and a second pulley 83. In this embodiment, two brackets 86 are disposed between the two davit arms 8, thereby enhancing the overall structure of the two davit arms 8 to bear the load.

The two first winches 91 are disposed on the upper deck 1 close to the center position C. The two first winches 91 each have a first cable 911 passing through the first pulley 84 of a corresponding one of the two davit arms 8 and connected to the fixed pulley assembly 642 of the fixed pulley mechanism 64. When the two first winches 91 each wind and unwind the first cable 911, the two davit arms 8 are pivoted up and down with the second end 82 as the axis, thereby adjusting the elevation angle of the two davit arms 8.

The two second winches 92 are disposed on the upper deck 1 close to the center position C. The two second winches 92 each have a second cable 921 passing through the second pulley 83 of a corresponding one of the two davit arms 8. A hook 85 for lifting an object is disposed at a distal end of the second cable 921.

Figure 10:
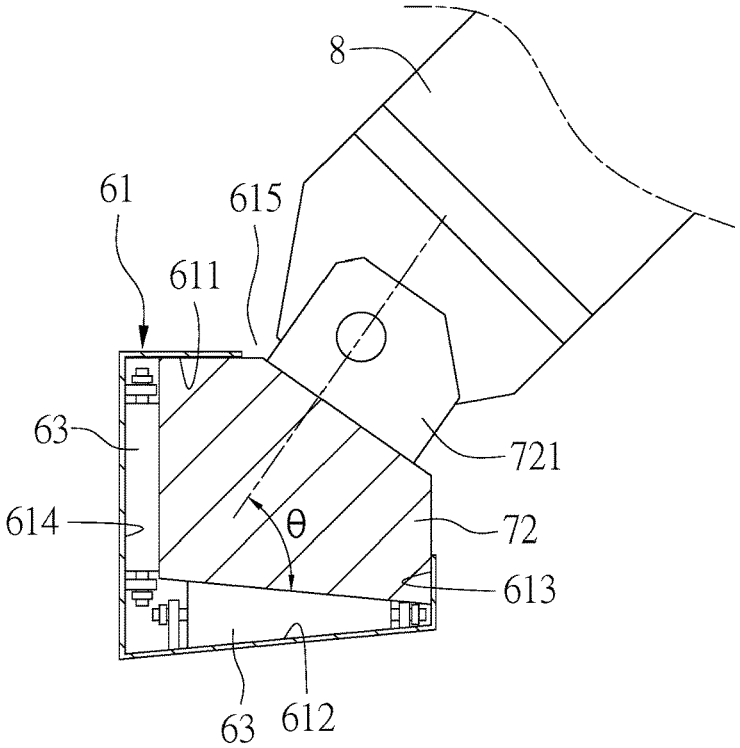
FIG. 10 is a sectional view of the base in the curved rail of the present invention.

Preferably, as shown in FIG. 10, the curved rail 61 has a rectangular cross section, and has a top surface 611, a bottom surface 612, a front surface 613 away from the center position C, and a rear surface 614 opposite to the front surface 614. An opening 615 is defined at the junction of the front surface 613 and the top surface 611. The pivot portions 721 of the two sliders 72 are exposed out of the curved rail 61 through the opening 615. Each of the bottom surface 612 and the rear surface 614 is provided with a plurality of first rollers 63. The bottom surface 612 is inclined toward the rear surface 614. Each of the first rollers 63 on the bottom surface 612 has a conical shape that is gradually enlarged toward the rear surface 614, so that the angle θ between each of the first rollers 63 on the bottom surface 612 and the corresponding davit arm 8 is about 90 degrees, thereby increasing the maximum load of the two davit arms 8.

Figure 11:
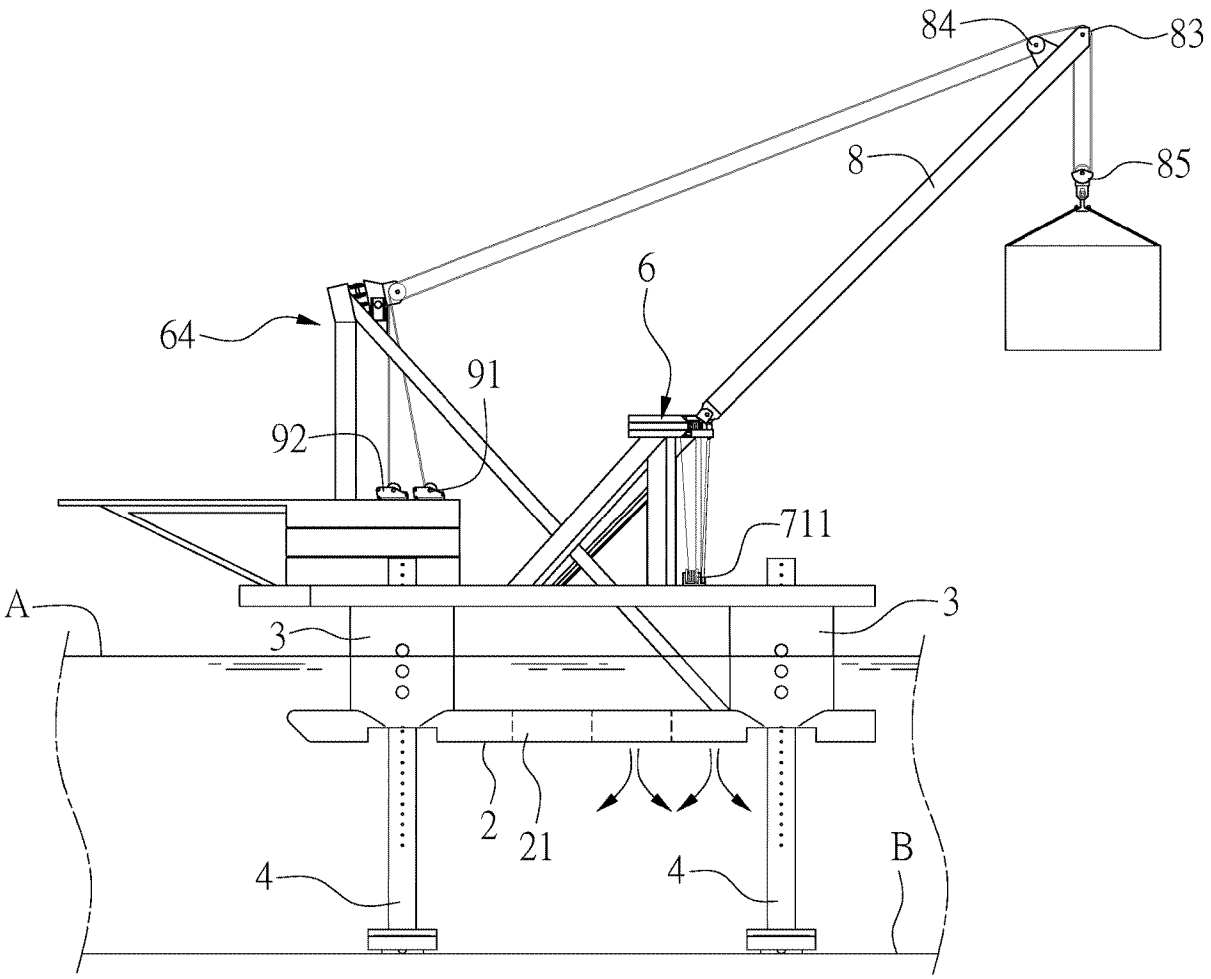
FIG. 11 is a schematic view of the present invention when in use, showing a heavy object hanged by the two davit arms.

In the actual use of the invention consisting of the above structures, the offshore platform lifting device provided by the present invention is sailed the working place on the sea surface A. The compartment 41 of each support leg 4 is filled with seawater, so the support leg 4 sinks to reach the seabed B to complete the fixing operation of the upper deck 1. When the operator wants to lift a heavy object, the heavy object is lifted by the hooks 85 of the two davit arms 8 and then the second cables 921 are wound by the two second winches 92, thereby lifting the heavy object. At the same time, the operator controls the lower pontoon 2 to drain the water in the chambers 21 adjacent to the two hooks 85 to maintain the center of gravity of the offshore platform lifting device (as shown in FIG. 11). The two third cables 712 are retracted by the two third winches 711, so that the two third cables 712 respectively drive the two sliders 72 to move along the curved rail 61. Through the two first cables 911 and the two second cables 921 respectively passing through the fixed pulley assembly 642, the fixed pulley assembly 642 is synchronously moved along the rail 643 along with the two davit arms 8, and the two davit arms 8 are laterally moved to a designated position. Then, the two second winches 92 unwind the second cables 921 to lower the heavy object vertically to the designated position to complete the lifting operation.

From the above description, the advantages of the present invention are described below.

1. The upright columns 3 are connected between the upper deck 1 and the lower pontoon 2. The support leg 4 is inserted through the upright column 3. After the support leg 4 is filled with water, it sinks to reach the seabed B. The leveling mechanism 5 disposed in the upright column 3 is combined with the support leg 4. After the lower pontoon 2 is filled with water, the center of gravity is moved down toward the sea surface A, so that the support leg 4 is stably supported on the seabed B. The upper deck 1 is moved up or down to a horizontal position. When the support leg 4 is filled with the seawater and sinks to the seabed B, the buoyancy of the lower pontoon 2 is sufficient to support the entire weight including the upper deck 1 and the lower pontoon 2, so that the upper deck 1 is maintained to be above the sea surface. When the aforementioned overall weight and the buoyancy of the lower pontoon 2 are balanced, the leveling mechanism 5, with the aid of the buoyancy of the lower pontoon 2, can easily elevate or lower the upper deck 1 with buoyancy along the support leg 4. This is beneficial for the horizontal fine adjustment of the upper deck 1 to achieve the effect of stable positioning of the platform. Besides, the sinking of the lower pontoon 2 and the support leg 4 is caused by injecting seawater, rather than a drive mechanism used for lifting, thereby saving cost and being economical.

2. The invention is different from the conventional offshore lifting platform which adopts a rotating mechanism to move and lift the heavy object. The invention adopts the two davit arms 8 to move the sliders along the curved rail 61 and the fixed pulley mechanism 64 located at the center position C, and cooperates with the driving of the first winches 91, the second winches 92 and the third winches 711. The invention not only allows the davit arms to load and lift the heavy object, but also moves the heavy object through the two davit arms 8 to perform horizontal and vertical pivoting movements to complete the lifting operation. In addition, through the simple design of the overall structure, the cost is reduced effectively further to reduce the cost of the offshore lifting operation greatly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An offshore platform lifting device for lifting operations at sea after sailed to a certain position of a sea surface, comprising:

an upper deck;

a plurality of upright columns, connected to the upper deck and supported on a seabed;

a rail seat, disposed on the upper deck, the rail seat having a curved rail, two ends of the curved rail being provided with retaining walls; the upper deck having a center position relative to the curved rail, the center position being provided with a fixed pulley mechanism;

a base, disposed on the curved rail, the base having a pushing device disposed on the upper deck for driving the base to slide along the curved rail;

two davit arms, each having a first end and a second end, the second ends of the two davit arms being pivotally connected to the base and arranged side by side, the first end being provided with a first pulley and a second pulley;

two first winches, disposed on the upper deck, the two first winches each having a first cable passing through the first pulley of a corresponding one of the two davit arms and connected to the fixed pulley mechanism, wherein when the two first winches each wind and unwind the first cable, the two davit arms are pivoted up and down with the second end as an axis;

two second winches, disposed on the upper deck, the two second winches each having a second cable passing through the second pulley of a corresponding one of the two davit arms, a hook being disposed at a distal end of the second cable.

2. The offshore platform lifting device as claimed in claim 1, wherein the upper deck is connected to a lower pontoon through the upright columns, each upright column is provided with a support leg that is longitudinally inserted through the upright column, the lower pontoon has a plurality of chambers therein, the chambers are configured to receive water therein so that the lower pontoon sinks downwardly when the water is introduced into the chambers or floats upwardly when the water is drained out; the support leg has a compartment, the compartment is configured to receive water therein so that the support leg sinks downwardly when the water is introduced into the compartment or floats upwardly when the water is drained out; each upright column includes a leveling mechanism therein, wherein when the support leg sinks to reach the seabed, the leveling mechanism in each upright column is combined with the support leg to support the support leg, and the leveling mechanism drives the upper deck to move up or down along the support leg.

3. The offshore platform lifting device as claimed in claim 2, wherein each upright column is provided with a wave-dissipating channel, the wave-dissipating channel has through holes on a plurality of sides of the upright column, the plurality of through holes communicate with each other through a pipe in the upright column, when a wave meets the upright column, seawater flows in through one of through holes and flows out through the other through holes via the pipe to eliminate the force of the wave against the upright column.

4. The offshore platform lifting device as claimed in claim 2, wherein the leveling mechanism located in each upright column has a plurality of upper positioning cylinders disposed in an upper seat and a plurality of lower positioning cylinders disposed in a lower seat, the upper seat and the lower seat are connected by a plurality of jacking cylinders, each of the upper positioning cylinders and the lower positioning cylinders has a positioning rod that is extendable and retractable horizontally, the support leg supported by the leveling mechanism has positioning holes for receiving the positioning rods of the upper positioning cylinders and the lower positioning cylinders, the positioning rods of the plurality of upper positioning cylinders or the positioning rods of the plurality of lower positioning cylinders are respectively extended into the positioning holes of the support leg, and the lower seat is driven to be close to or away from the upper seat by the plurality of jacking cylinders for driving the upper deck to move up or down.

5. The offshore platform lifting device as claimed in claim 1, wherein the fixed pulley mechanism includes a positioning seat and a fixed pulley assembly pivotally connected to the positioning seat, the positioning seat has a rail below the fixed pulley assembly, a bottom of the fixed pulley assembly has a plurality of second rollers, and the fixed pulley assembly slides along the rail via the second rollers.

6. The offshore platform lifting device as claimed in claim 5, wherein a hydraulic device is disposed on the positioning seat, the hydraulic device is configured to drive the fixed pulley assembly, so that the fixed pulley assembly is pivoted laterally along the rail with its pivotal joint as an axis.

7. The offshore platform lifting device as claimed in claim 1, wherein at least one bracket is disposed between the two davit arms.

8. The offshore platform lifting device as claimed in claim 1, wherein the base has a pivot portion exposed out of the curved rail, and the second ends of the two davit arms are pivotally connected to the pivot portion and arranged side by side.

9. The offshore platform lifting device as claimed in claim 8, wherein the curved rail has a rectangular cross section, the curved rail has a top surface, a bottom surface, a front surface away from the center position and a rear surface opposite to the front surface, an opening is defined at the junction of the front surface and the top surface, the pivot portion of the base is exposed out of the curved rail through the opening, and each of the bottom surface and the rear surface is provided with a plurality of first rollers.

10. The offshore platform lifting device as claimed in claim 9, wherein the bottom surface is inclined toward the rear surface, and each of the first rollers on the bottom surface has a conical shape that is gradually enlarged toward the rear surface.

11. The offshore platform lifting device as claimed in claim 1, wherein the pushing device is composed of two third winches disposed on the upper deck; the base is composed of two sliders respectively disposed on the two davit arms, each of the two sliders is provided with a third pulley, each of the two retaining walls is provided with a diverting pulley, the two third winches each have a third cable passing through the diverting pulley and connected to the third pulley, when the two third winches each wind and unwind the third cable, the two sliders slide along the curved rail.

* * * * *